US009048634B2

(12) United States Patent
Chaudhry et al.

(10) Patent No.: US 9,048,634 B2
(45) Date of Patent: Jun. 2, 2015

(54) WATER RESISTANT DIRECT SPARK IGNITER

(71) Applicant: Rheem Manufacturing Company, Atlanta, GA (US)

(72) Inventors: Raheel A. Chaudhry, Montgomery, AL (US); Troy Trant, Montgomery, AL (US); Timothy D. Scott, Tallassee, AL (US); Rodney K. Pugh, Wetumpka, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 213 days.

(21) Appl. No.: 13/749,768

(22) Filed: Jan. 25, 2013

(65) Prior Publication Data

US 2014/0021852 A1 Jan. 23, 2014

Related U.S. Application Data

(60) Provisional application No. 61/672,820, filed on Jul. 18, 2012.

(51) Int. Cl.
*F23Q 3/00* (2006.01)
*H01T 13/20* (2006.01)

(52) U.S. Cl.
CPC ..... *H01T 13/20* (2013.01)

(58) Field of Classification Search
CPC .. H01T 1/00–24/00; F23Q 3/00; F23Q 3/008; F23Q 9/00; F23N 2027/36
USPC ..... 122/17.1, 17.2; 313/141; 431/6, 263, 431/264
See application file for complete search history.

(56) References Cited

U.S. PATENT DOCUMENTS

| | | | | |
|---|---|---|---|---|
| 2,290,526 | A | 4/1941 | Berkey et al. | |
| 3,416,735 | A * | 12/1968 | Reed | 239/567 |
| 4,527,085 | A | 7/1985 | Bohan, Jr. et al. | |
| 6,808,389 | B1 | 10/2004 | Glidden | |
| 2008/0118878 | A1 * | 5/2008 | Glidden | 431/266 |
| 2009/0140623 | A1 | 6/2009 | Ugalde | |
| 2012/0288806 | A1 * | 11/2012 | Racaj | 431/18 |

FOREIGN PATENT DOCUMENTS

| | | |
|---|---|---|
| EP | 0257725 | 3/1988 |
| EP | 2014986 | 7/2007 |

* cited by examiner

*Primary Examiner* — Donald Raleigh

(74) *Attorney, Agent, or Firm* — Haynes and Boone, LLP

(57) ABSTRACT

A direct spark igniter for a fuel-fired heating appliance is provided with enhanced ignition performance in environments having substantial levels of both moisture and pollution. Such enhanced ignition performance is representatively achieved by the combination of (1) forming external annular ribs on the ceramic body portion of the igniter; (2) extending a top end of the igniter electrode rod into the body portion; (3) bending the igniter electrode and ground rods and angling them toward one another; and (4) knurling external side surfaces on lower end portions of the igniter electrode and ground rods.

5 Claims, 2 Drawing Sheets

WATER RESISTANT DIRECT SPARK IGNITER

CROSS-REFERENCE TO RELATED APPLICATION

The present application claims the benefit of the filing date of provisional U.S. patent application no, 61/672,820 filed Jul. 18, 2012. The entire disclosure of the provisional application is hereby incorporated herein by this reference.

BACKGROUND OF THE INVENTION

The present invention relates generally to direct spark igniters utilized in various types of fuel-fired heating appliances. More particularly, the present invention provides a direct spark igniter, representatively one useable in the combustion chamber of a downfired water heater, which is specially designed to satisfactorily operate in polluted, moisture-laden environments.

It has been observed in the fuel-fired appliance industry that various types of fuel-fired appliances utilizing direct spark igniters may experience improper behavior associated with no ignition event and/or delayed ignition. It has also been observed that conventionally designed direct spark igniters used, for example, in fuel-fired water heaters have little resistance to performance degradation arising when the igniters are operated in polluted and moisture-laden environments, thereby leading to improper spark operation. Because of this it can be readily seen that an improved direct spark igniter design, which provides improved operation in the presence of moisture and a substantial level of contamination/pollution, is needed. It is to this goal that the present invention is primarily directed.

DETAILED DESCRIPTION

Figure 1:
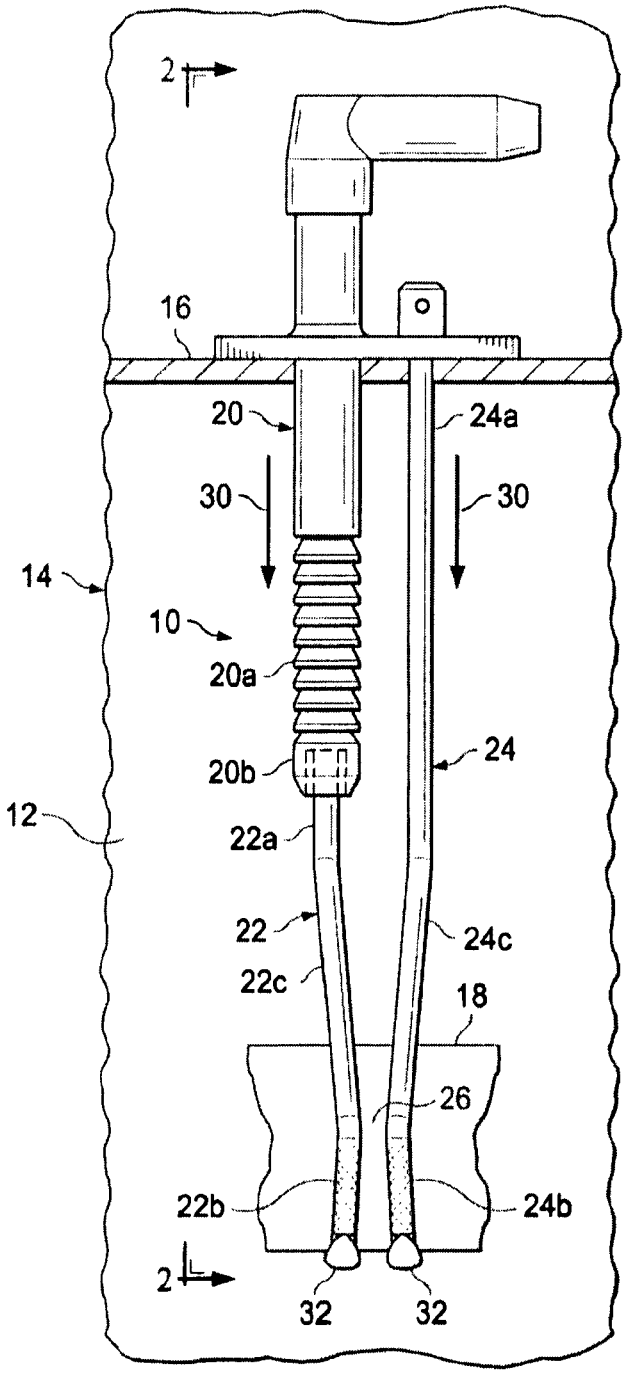
FIG. 1 is a front elevational view of the igniter.
Figure 2:
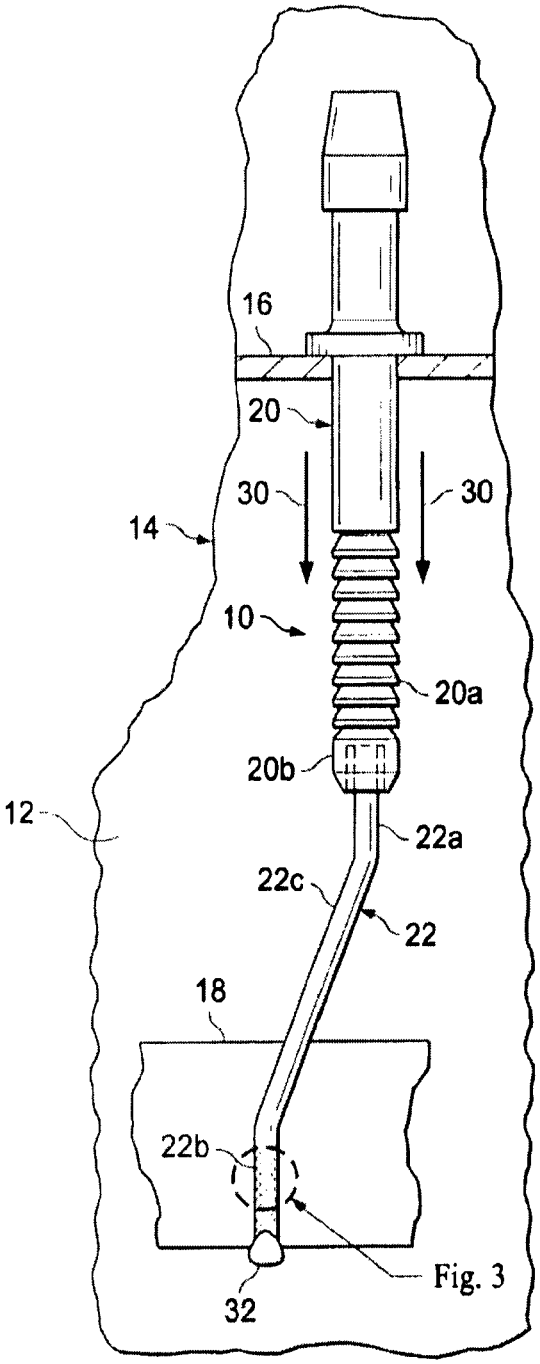
FIG. 2 is a side elevational view of the igniter taken along line 2-2 of FIG. 1.

Turning first to FIGS. 1 and 2, in an illustrative embodiment thereof the present invention provides a specially designed direct spark igniter 10 which is representatively vertically oriented and extends downwardly into a combustion chamber portion 12 of a fuel-fired heating appliance 14 through an outer metal wall 16 of the combustion chamber 12. The igniter 10 is utilized to selectively ignite a fuel burner 18 in the combustion chamber 12 when heating operation of the appliance 14, representatively a downfired water heater in which the combustion chamber may have substantial levels of both moisture and pollution therein, is desired.

The vertically oriented igniter 10 comprises a vertically elongated cylindrical ceramic body 20 having an externally ribbed lower longitudinal portion 20*a*, and a hollow lower end 20*b*. Extending downwardly from the lower end 20*b* of the ceramic body 20 is an elongated high voltage electrode rod 22 having a vertically extending upper end portion 22*a* extending into the interior of the hollow lower ceramic body end 20*b*, a vertically extending lower end portion 22*b*, and a sloping longitudinally intermediate portion 22*c* which horizontally offsets the upper and lower rod portions 22*a*,22*b* from one another. Igniter 10 also includes a vertically elongated ground rod 24 having an upper longitudinal portion 24*a* opposite the ceramic body 20, a lower end portion 24*b* opposite the lower electrode rod end portion 22*b*, and a sloping longitudinally intermediate portion 24*c* which horizontally offsets the portions 24*a*,24*b* of the ground rod 24.

Figure 3:
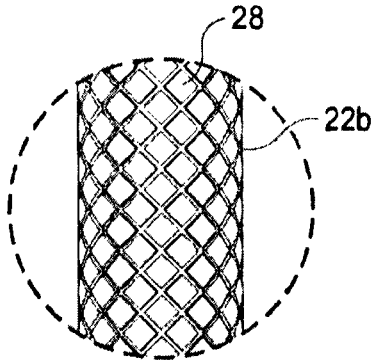
FIG. 3 is an enlargement of the dash-circled area in FIG. 2.

As can be seen from the front in FIG. 1, the rod portions 22*c*,24*c* slope downwardly and toward one another to form a minimum spark gap 26 between the rods 22,24. From the lower ends of the rod portions 22*c*,24*c*, the lower rod end portions 22*b*,24*b* slope downwardly and away from one another such that the lower ends of the rod portions 22*b*,24*b* are horizontally spaced away from one another by a distance greater than the width of the spark gap 26. For purposes later described, the lower rod end portions 22*b*,24*b* are externally knurled as at 28 (see FIG. 3 which shows the knurling on the exterior of the lower rod portion 22*b*).

To ignite the burner 18, high electrical voltage is supplied to the electrode rod 22 to create sparks across the rod gap 26 while fuel from an external source (not shown) is flowed to the burner 18, and combustion air 30 from an external source (also not shown) is flowed downwardly through the combustion chamber 12 outwardly along the igniter 10 to the burner 18.

Due to a unique combination of four features representatively incorporated therein, the igniter 10 is advantageously provided with enhanced ignition performance in environments having substantial levels of both moisture and pollution. Such features include:

1. the receipt of the upper end portion 22*a* of the high voltage electrode rod 22 within the hollow lower ceramic body end 20*b* that increases the creepage distance of the rod 22 to thereby increase the level of pollution that the igniter 10 may properly function in, while at the same time inhibiting water from making contact with the electrode rod 22 while providing a conduction path back to ground;

2. the provision of external annular ribs on the ceramic body portion that function to permit the downwardly flowing air 30 to deflect water traveling down the ribbed portion 20*a* horizontally away from the ceramic body 20, thereby lessening the amount of water flowing along the rod 22 to the juncture of its portions 22*b*,22*c*, and also increasing the electrode rod creepage distance along the exterior of the ceramic body 20;

3. the angled configuration of the igniter rods 22,24 that places the optimum spark gap 26 substantially higher than the lower ends of the rods 22,24, whereby water flowing downwardly along the rods will tend to collect (as at 32 in FIGS. 1 and 2) at the lower rod ends, tending to leave the spark area 26 dry; and 4. the external knurling 28 on the lower rod ends 22*b*,24*b* that provides more external surface area, and thus more "spark" area, and also creates "peaks" that project laterally outwardly beyond any water collecting on the lower rod ends, thereby further enhancing the operation of the igniter 10 in high moisture conditions.

While it has proven to be most preferable to provide the igniter 10 with a combination of all four of these features, substantial improvements to ignition performance of the igniter 10 in polluted, moisture laden environments may be obtained by incorporating a lesser number of these improvements (for example, any three thereof) into the igniter 10.

To applicants' knowledge there are no current direct spark igniters available that claim to work in high moisture and contamination conditions. In developing the igniter 10 described above, high voltage engineering principles were uniquely applied to the fuel fired appliance art to define igniters uniquely tailored for condensing appliances such as condensing type water heaters. A summary of these design techniques, along with definitions of various technical terms used herein, are set forth in the accompanying Exhibit A which forms a part of this patent application.

The foregoing detailed description is to be clearly understood as being given by way of illustration and example only, the spirit and scope of the present invention being limited solely by the appended claims.

What is claimed is:

1. A moisture and pollution resistant direct spark igniter comprising:

a cylindrical ceramic body having external annular ribs thereon and a lower end into which an opening upwardly extends;

a vertically elongated high voltage electrode rod having an upper end received in said body opening; and a vertically elongated ground rod supported in a spaced apart, generally side-by-side relationship with said body and said electrode rod, lower end portions of said electrode rod and said ground rod being horizontally offset from upper end portions of said electrode rod and said ground rod by longitudinally intermediate portions of said electrode rod and said ground rod that slope downwardly and horizontally toward one another, said lower end portions of said electrode rod and said ground rod further having knurled external side surfaces and sloping downwardly and horizontally away from one another, juncture areas between said longitudinally intermediate and lower end portions of said electrode rod and said ground rod forming therebetween a spark gap area spaced upwardly apart from the lower ends of said electrode rod and said ground rod.

2. A moisture and pollution resistant direct spark igniter comprising:

a cylindrical ceramic body having external annular ribs thereon and a lower end;

a vertically elongated high voltage electrode rod longitudinally extending downwardly from said lower end of said ceramic body; and a vertically elongated ground rod supported in a spaced apart, generally side-by-side relationship with said body and said electrode rod, lower end portions of said electrode rod and said ground rod being horizontally offset from upper end portions of said electrode rod and said ground rod by longitudinally intermediate portions of said electrode rod and said ground rod that slope downwardly and horizontally toward one another, said lower end portions of said electrode rod and said ground rod further having knurled external side surfaces and sloping downwardly and horizontally away from one another, juncture areas between said longitudinally intermediate and lower end portions of said electrode rod and said ground rod forming therebetween a spark gap area spaced upwardly apart from the lower ends of said electrode rod and said ground rod.

3. A moisture and pollution resistant direct spark igniter comprising:

a cylindrical ceramic body having a lower end into which an opening upwardly extends;

a vertically elongated high voltage electrode rod having an upper end received in said body opening; and a vertically elongated ground rod supported in a spaced apart, generally side-by-side relationship with said body and said electrode rod, lower end portions of said electrode rod and said ground rod being horizontally offset from upper end portions of said electrode rod and said ground rod by longitudinally intermediate portions of said electrode rod and said ground rod that slope downwardly and horizontally toward one another, said lower end portions of said electrode rod and said ground rod further having knurled external side surfaces and sloping downwardly and horizontally away from one another, juncture areas between said longitudinally intermediate and lower end portions of said electrode rod and said ground rod forming therebetween a spark gap area spaced upwardly apart from the lower ends of said electrode rod and said ground rod.

4. A moisture and pollution resistant direct spark igniter comprising:

a cylindrical ceramic body having external annular ribs thereon and a lower end into which an opening upwardly extends;

a vertically elongated high voltage electrode rod having an upper end received in said body opening, and a lower end;

a vertically elongated ground rod supported in a spaced apart, generally side-by-side relationship with said body and said electrode rod and having a lower end, a narrowed spark gap area being formed between spaced apart portions of said electrode rod and said ground rod at a location spaced upwardly apart from said lower ends of said electrode rod and said ground rod; and knurled external side surfaces disposed on lower end portions of said electrode rod and said ground rod.

5. A moisture and pollution resistant direct spark igniter comprising:

a cylindrical ceramic body having external annular ribs thereon and a lower end into which an opening upwardly extends;

a vertically elongated high voltage electrode rod having an upper end received in said body opening; and a vertically elongated ground rod supported in a spaced apart, generally side-by-side relationship with said body and said electrode rod, lower end portions of said electrode rod and said ground rod being horizontally offset from upper end portions of said electrode rod and said ground rod by longitudinally intermediate portions of said electrode rod and said ground rod that slope downwardly and horizontally toward one another, said lower end portions of said electrode rod and said ground rod further sloping downwardly and horizontally away from one another, juncture areas between said longitudinally intermediate and lower end portions of said electrode rod and said ground rod forming therebetween a spark gap area spaced upwardly apart from the lower ends of said electrode rod and said ground rod.

* * * * *